US010938100B2

(12) United States Patent
Wu et al.

(10) Patent No.: US 10,938,100 B2
(45) Date of Patent: Mar. 2, 2021

(54) DUAL-FEED LOOP ANTENNA STRUCTURE AND ELECTRONIC DEVICE

(71) Applicant: PEGATRON CORPORATION, Taipei (TW)

(72) Inventors: Chien-Yi Wu, Taipei (TW); Chao-Hsu Wu, Taipei (TW); Shih-Keng Huang, Taipei (TW); Ching-Hsiang Ko, Taipei (TW); Sheng-Chin Hsu, Taipei (TW); Cheng-Hsiung Wu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 10 days.

(21) Appl. No.: 16/557,743

(22) Filed: Aug. 30, 2019

(65) Prior Publication Data

US 2020/0083603 A1 Mar. 12, 2020

(30) Foreign Application Priority Data

Sep. 10, 2018 (TW) ..... 107131659

(51) Int. Cl.
*H01Q 1/52* (2006.01)
*H01Q 1/48* (2006.01)
(Continued)

(52) U.S. Cl.
CPC ..... *H01Q 1/521* (2013.01); *H01Q 1/48* (2013.01); *H01Q 5/335* (2015.01); *H01Q 5/35* (2015.01); *H01Q 7/00* (2013.01); *H01Q 9/045* (2013.01)

(58) Field of Classification Search
CPC ..... H01Q 1/521; H01Q 1/48; H01Q 1/523; H01Q 1/526; H01Q 1/38; H01Q 1/50; H01Q 1/22; H01Q 5/335; H01Q 5/35; H01Q 5/371; H01Q 5/10; H01Q 5/20; H01Q 5/40; H01Q 7/00; H01Q 9/045; H01Q 9/06
See application file for complete search history.

(56) References Cited

U.S. PATENT DOCUMENTS 9,563,838 B2 2/2017 Ban et al.
2012/0038519 A1* 2/2012 Su ..... H01Q 21/28 343/702
(Continued)

FOREIGN PATENT DOCUMENTS

CN 202817173 3/2013
JP H06169216 6/1994

*Primary Examiner* — Raymond R Chai
(74) *Attorney, Agent, or Firm* — J.C. Patents

(57) ABSTRACT

A dual-feed loop antenna structure adapted to be disposed on a substrate includes two loop antennas and two open-loop grounding radiators. Each of the loop antennas is used for resonating at a first frequency band and a second frequency band and includes a feed-in end and a ground segment. The two open-loop grounding radiators are located between the two loop antennas. Each of the open-loop grounding radiators extends from the ground segment of the corresponding loop antenna. A coupling gap is formed between the two open-loop grounding radiators. One of the loop antennas and the open-loop grounding radiator connected thereto completely overlap the other loop antenna and the other open-loop grounding radiator connected thereto after being mirrored and reversed. An electronic device is further provided.

15 Claims, 10 Drawing Sheets

(51) Int. Cl.

| | |
|---|---|
| ***H01Q 7/00*** | (2006.01) |
| ***H01Q 9/04*** | (2006.01) |
| ***H01Q 5/335*** | (2015.01) |
| ***H01Q 5/35*** | (2015.01) |

(56) References Cited

U.S. PATENT DOCUMENTS

2012/0038534 A1* 2/2012 Su ..... H01Q 7/00
343/835
2012/0056790 A1* 3/2012 Lee ..... H01Q 21/30
343/702
2015/0295311 A1 10/2015 Bringuier et al.

* cited by examiner

DUAL-FEED LOOP ANTENNA STRUCTURE AND ELECTRONIC DEVICE

CROSS-REFERENCE TO RELATED APPLICATION

This application claims the priority benefit of Taiwan application serial no. 107131659, filed on Sep. 10, 2018. The entirety of the above-mentioned patent application is hereby incorporated by reference herein and made a part of this specification.

BACKGROUND

Technology Field

The present disclosure relates to an antenna structure and an electronic device having the same, and more particularly to a dual-feed loop antenna structure and an electronic device having the dual-feed loop antenna structure.

Description of Related Art

The conventional loop antenna structure only has a single feed-in end. However, as the operating bands increase, an antenna with a single feed-in end may be insufficient for use. In addition, conventional loop antennas require large ground planes and are typically directly bonded to the system ground plane. Therefore, the conventional loop antennas require larger space. With the demand for miniaturization of electronic devices, when designing multiple antennas in limited space, it is necessary to take into account the isolation between the antennas and the radiation pattern of the antennas, which is a challenge in antenna design.

SUMMARY

The disclosure provides a dual-feed loop antenna structure, which can be small in size, has good isolation, omnidirectional radiation pattern and good dual frequency performance.

The present disclosure provides an electronic device having the dual-feed loop antenna structure.

The dual-feed loop antenna structure of the present disclosure is adapted for being arranged on a substrate, and the dual-feed loop antenna structure includes a two loop antennas and two open-loop grounding radiators. Each of the loop antennas is configured to resonate at a first frequency band and a second frequency band, and each of the loop antennas includes a feed-in end and a ground segment. The two open-loop grounding radiators are located between the two loop antennas, and each of the open-loop grounding radiators extends from the grounding segment of the corresponding loop antenna, and a coupling gap is formed between the two open-loop grounding radiators. One of the loop antennas and the open-loop grounding radiator connected thereto completely overlap the other loop antenna and the other open-loop grounding radiator connected thereto after being mirrored and reversed.

In an embodiment of the disclosure, the coupling gap has a width of between 0.5 mm and 1.5 mm.

In an embodiment of the disclosure, the length of each loop antenna is in a range between ¾ wavelength and 1 wavelength of the first frequency band.

In an embodiment of the disclosure, the sum of the lengths of the two open-loop grounding radiators is ½ wavelength of the first frequency band.

In an embodiment of the disclosure, the length of each open-loop grounding radiator is ¼ wavelength of the first frequency band.

In an embodiment of the disclosure, the length of the ground segment of each loop antenna is ¼ wavelength of the first frequency band.

In an embodiment of the present disclosure, the dual-feed loop antenna structure further includes two coaxial transmission lines disposed on the two respective loop antennas, and a positive end of each coaxial transmission line is connected to the feed-in end of the corresponding loop antenna. A negative end of each coaxial transmission line is connected to a ground segment of the corresponding loop antenna.

In an embodiment of the disclosure, each of the coaxial transmission lines has a length of between 145 mm and 300 mm.

In an embodiment of the disclosure, each of the loop antennas includes a first extension segment extending from the feed-in end, and the length or width of the first extension segment is adjusted to adjust impedance matching of the second frequency band.

In an embodiment of the disclosure, each of the loop antennas includes a second extension segment extending from a corner close to the feed-in end, and the length or width of the second extension segment is adjusted to adjust the impedance matching of the first frequency band.

In an embodiment of the disclosure, the first frequency band is between 2400 MHz and 2500 MHz, and the second frequency band is between 5150 MHz and 5875 MHz.

An electronic device of the present disclosure includes a housing, a circuit board, at least one dual-feed loop antenna structure and at least one shielding member.

The circuit board is disposed in the housing. The at least one dual-feed loop antenna structure is disposed in the housing with signal connection to the circuit board. The at least one shielding member is disposed in the housing and located between the dual-feed loop antenna structure and the circuit board.

In an embodiment of the disclosure, the distance between the at least one dual-feed loop antenna structure and the corresponding shielding member is between 15 mm and 70 mm.

In an embodiment of the disclosure, the housing is a cylinder, an ellipsoid, a cuboid, a trapezoidal column, or a rugby ball body.

In an embodiment of the disclosure, the at least one dual-feed loop antenna structure includes a plurality of dual-feed loop antenna structures symmetrically disposed in the housing.

Based on the above, the dual-feed loop antenna structure of the present disclosure is designed by configuring two open-loop grounding radiators between two loop antennas and respectively extending from the two ground segments of the two loop antennas, and there is a coupling gap between the two open-loop grounding radiators. In the above design, for one of the loop antennas (for example, the first loop antenna), the two open-loop grounding radiators and the other loop antenna (for example, the second loop antenna) can be used together as the grounding radiator of the loop antenna (the first loop antenna), such that the loop antenna has a larger ground path. Similarly, for the other loop antenna (for example, the second loop antenna), the two open-loop grounding radiators and another loop antenna (for example, the first loop antenna) can be used together as the grounding radiator of the loop antenna (the second loop antenna), such that the loop antenna a larger ground path. In other words, for both of the two loop antennas, the two open-loop grounding radiators and the other loop antenna can be used together as their own grounding radiators, such that each of the loop antennas has a large ground path to provide good impedance matching. In addition, the two open-loop grounding radiators can also provide good isolation for the two loop antennas. Since the two loop antennas can be quite close and do not interfere with each other, the dual-feed loop antenna structure has a smaller size. Therefore, the dual-feed loop antenna structure can resonate at the first frequency band and the second frequency band with good signals in a limited space and thus achieving good dual frequency characteristics.

In order to make the aforementioned features and advantages of the disclosure more comprehensible, embodiments accompanying figures are described in detail below.

DETAILED DESCRIPTION

Figure 1:
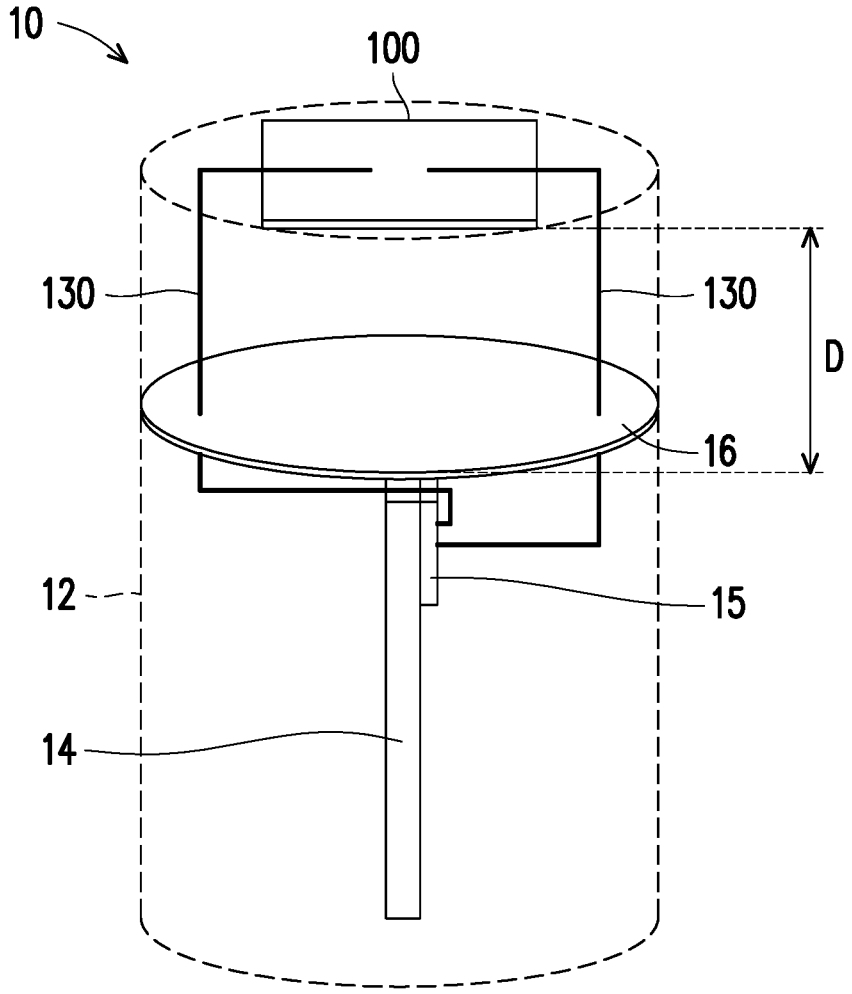
FIG. 1 is a schematic view of an electronic device according to an embodiment of the present disclosure.

FIG. 1 is a schematic view of an electronic device according to an embodiment of the present disclosure. Referring to FIG. 1, an electronic device 10 of the present embodiment includes a housing 12, a circuit board 14, a dual-feed loop antenna structure 100, and a shielding member 16. In this embodiment, the electronic device 10 is, for example, an intelligent speaker, but the type of the electronic device 10 is not limited thereto. As shown in FIG. 1, in the present embodiment, the shape of the housing 12 is, for example, a cylinder. Certainly, the shape of the housing 12 is not limited thereto. In other embodiments, the housing 12 may also be an ellipsoid, a cuboid, a trapezoidal column, or a rugby ball body. The material of the housing 12 is, for example, plastic, but the material of the housing 12 is not limited thereto, as long as the material of the part of the housing 12 near the dual-feed loop antenna structure 100 is non-metal.

In order to clearly show the relative positions of the circuit board 14, the dual-feed loop antenna structure 100 and the shielding member 16 in FIG. 1, the housing 12 is shown by dotted lines. As shown in FIG. 1, in this embodiment, the circuit board 14, the dual-feed loop antenna structure 100, and the shielding member 16 are disposed in the housing 12, and the circuit board 14 is isolated from the dual-feed loop antenna structure 100 by the shielding member 16. That is, the shielding member 16 is positioned between the dual-feed loop antenna structure 100 and the circuit board 14. In this embodiment, the dual-feed loop antenna structure 100 is positioned on the inner surface of the top of the housing 12, but the position of the dual-feed loop antenna structure 100 is not limited thereto.

In addition, in this embodiment, the material of the shielding member 16 is metal, and may be used for mitigating the impact of an interference source on the circuit board 14 on the wireless reception quality. Certainly, the material of the shielding member 16 is not limited thereto. In addition, in this embodiment, the distance D between the dual-feed loop antenna structure 100 and the shielding member 16 is greater than at least 15 mm, for reducing the impact of the shielding member 16 on the dual-feed loop antenna structure 100. The distance D between the dual-feed loop antenna structure 100 and the shielding member 16, for example, ranges from 15 mm to 70 mm but is not limited thereto.

In this embodiment, the dual-feed loop antenna structure 100 has signal connection with a wireless module card 15 of the circuit board 14. More specifically, the dual-feed loop antenna structure 100 is connected to the wireless module card 15 of the circuit board 14 through two coaxial transmission lines 130, and the shielding member 16 may be provided with corresponding through holes or recesses to allow the coaxial transmission lines 130 to pass through. The length of each of the coaxial transmission lines 130, for example ranges from 145 mm to 300 mm so as to obtain a better impedance matching effect.

Figure 2:
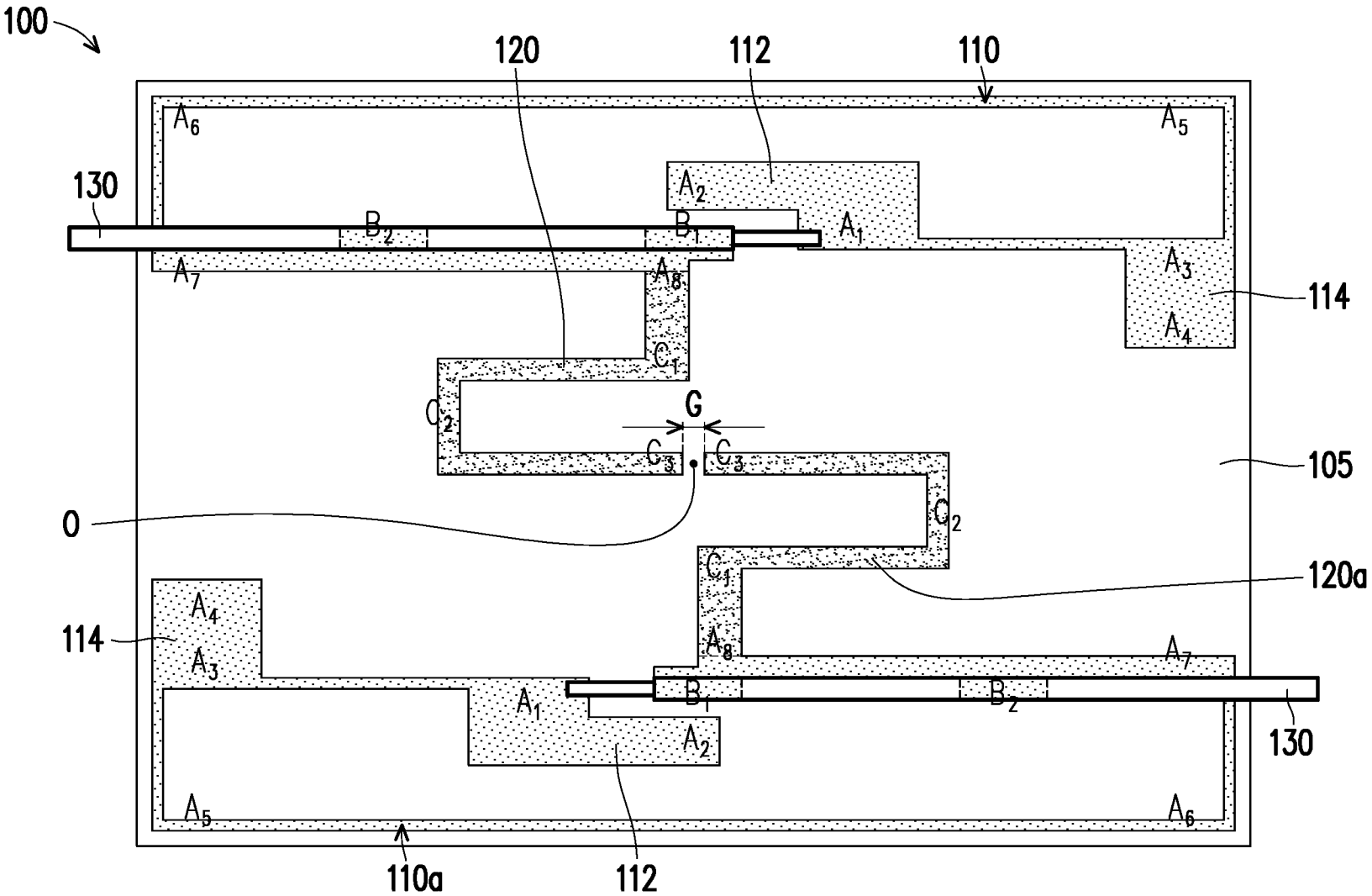
FIG. 2 is a schematic view of a dual-feed loop antenna structure of the electronic device of FIG. 1.

The detailed structure of the dual-feed loop antenna structure 100 is illustrated below. FIG. 2 is a schematic view of the dual-feed loop antenna structure of the electronic device of FIG. 1. Referring to FIG. 2, the dual-feed loop antenna structure 100 of this embodiment includes two loop antennas 110 and 110*a*. Each of the loop antennas 110 and 110*a* is used for resonating at a first frequency band and a second frequency band. In this embodiment, the first frequency band, for example, ranges from 2400 MHz to 2500 MHz, and the second frequency band, for example, ranges from 5150 MHz to 5875 MHz. In other words, in this embodiment, each of the loop antennas 110 and 110*a* is a dual-frequency loop antenna of WiFi 2.4 GHz and WiFi 5 GHz. Certainly, the ranges of the first frequency bands and the second frequency bands of each of the loop antennas 110 and 110*a* are not limited thereto.

In this embodiment, each of the loop antennas 110 and 110*a* includes a feed-in end and a ground segment. More specifically, each of the loop antennas 110 and 110*a* is formed by a radiator extending along the points A1, A3, A5, A6, A7 and A8, wherein the feed-in end is at the point A1, and the ground segment is a segment between the points A7 and A8. In this embodiment, the length of each of the loop antennas 110 and 110*a* is in a range between ¾ wavelength and 1 wavelength of the first frequency band. Preferably, the lengths of the loop antennas 110 and 110*a* are 1 wavelength of the first frequency band. That is, the loop antennas 110 and 110*a* may be full-wavelength loop antennas. Further, in the present embodiment, the length of the ground segment (the segment between the points A7 and A8) of each of the loop antennas 110 and 110*a* is ¼ wavelength of the first frequency band.

Further, in the present embodiment, the second frequency band (WiFi 5G) is the second harmonic frequency of the first frequency band (WiFi 2.4G). Each of the loop antennas 110 and 110*a* includes a first extension segment 112 extending from the feed-in end, that is, a segment between the point A1 and the point A2. A designer can adjust the length or width of the first extension segment 112 to adjust the resonance bandwidth and impedance matching of the second frequency band (WiFi 5G). Moreover, each of the loop antennas 110 and 110*a* includes a second extension segment 114 extending from the corner near the feed-in end, that is, a segment between the point A3 and the point A4. A designer can adjust the length or width of the second extension segment 114 to adjust the resonance bandwidth and impedance matching of the first frequency band (WiFi 2.4G).

Additionally, in this embodiment, the dual-feed loop antenna structure 100 may be disposed on a substrate 105. The substrate 105 is, for example, a flexible circuit board 14 or a hard circuit board 14, and the type of the substrate 105 is not limited thereto. In this embodiment, the length, width, and height of the substrate 105 are, for example, 50 mm, 35 mm, and 0.4 mm, respectively. The length and width of each of the loop antennas 110 and 110*a* are, for example, 50 mm and 8 mm, respectively. When the two loop antennas 110 and 110*a* are both disposed on the substrate 105, the two loop antennas 110 and 110*a* are quite close (for example, 19 mm). In this embodiment, for having good isolation (e.g., less than −15 dB) at the first frequency band (such as WiFi 2.4 GHz) so as to reduce the probability that the two loop antennas 110 and 110*a* mutually interfere because they are excessively close to each other, and for having a long enough ground path between the two loop antennas 110 and 110*a*, the dual-feed loop antenna structure 100 further includes two open-loop grounding radiators 120 and 120*a*.

As shown in FIG. 2, in the present embodiment, the two open-loop grounding radiators 120 and 120*a* are located between the two-loop antennas 110 and 110*a*, and each of the open-loop grounding radiators 120 and 120*a* extends from the ground segment (segment between the points A7 and A8) of the corresponding loop antennas 110 and 110*a*. More specifically, the open-loop grounding radiator 120 extends from the point A8 of the loop antenna 110, and the open-loop grounding radiator 120*a* extends from the point A8 of the corresponding loop antenna 110*a*.

In the present embodiment, the open-loop grounding radiators 120 and 120*a* are formed by radiators extending along the points C1, C2, and C3. In more details, the shape of each of the open-loop grounding radiators 120 and 120*a* is formed by connecting four segments in a bending manner, but the shape of each of the open-loop grounding radiators 120 and 120*a* may vary, depending on the arrangement space and not limited thereto, as long as the arrangement satisfies that the sum of the lengths of the two open-loop grounding radiators 120 and 120*a* is equal to ½ wavelength of the first frequency band. In this embodiment, the open-loop grounding radiators 120 and 120*a* are of equal length, and therefore, the length of each of the open-loop grounding radiators 120 and 120*a* is equal to ¼ wavelength of the first frequency band. In addition, in the present embodiment, the two open-loop grounding radiators 120 and 120*a* are disposed on the substrate 105, for example, in an attaching manner. Certainly, the manner in which the open-loop grounding radiators 120 and 120*a* are disposed on the substrate 105 is not limited thereto.

In the dual-feed loop antenna structure 100 of the present embodiment, the two open-loop grounding radiators 120 and 120*a* are disposed between the two loop antennas 110 and 110*a* and individually extend from the two ground segments of the two loop antennas 110 and 110*a*. For the loop antenna 110 with such design, the two open-loop grounding radiators 120 and 120*a* and the other loop antenna 110*a* can work together as the grounding radiator of the loop antenna 110 to enlarge the ground path of the loop antenna 110, thereby providing good impedance matching. Similarly, for the loop antenna 110*a* with such design, the two open-loop grounding radiators 120 and 120*a* and the loop antenna 110 can work together as the grounding radiator of the loop antenna 110*a* to enlarge the ground path of the loop antenna 110*a*, thereby providing good impedance matching.

Further, in the present embodiment, a coupling gap G is formed between the two open-loop grounding radiators 120 and 120*a*. In the present embodiment, the distance between the two end portions of the two open-loop grounding radiators 120 and 120*a* at the position C3 is defined as the coupling gap G. In an embodiment, the width of the coupling gap G is between 0.5 mm and 1.5 mm. Preferably, the width of the coupling gap G is 1 mm. The design of the coupling gap G between the two open-loop grounding radiators 120 and 120*a* has the isolation (i.e., S21) of the first frequency band (for example, WiFi 2.4 GHz) less than a specific value (for example, less than −15 dB), and thus attains good isolation. Moreover, the design of the coupling gap G between the two open-loop grounding radiators 120 and 120*a* has the envelope correlation coefficient (ECC) of the first frequency band (for example, WiFi 2.4 GHz) less than a specific value (for example, less than 0.1).

In addition, in the present embodiment, one of the loop antennas 110 and the open-loop grounding radiator 120 connected thereto completely overlap with the other loop antenna 110*a* and the other open-loop grounding radiator 120 connected thereto after being mirrored and reversed. More specifically, as shown in FIG. 2, in the present embodiment, the dual-feed loop antenna structure 100 has a virtual center O, wherein one loop antenna 110 and the open-loop grounding radiator 120 connected thereto overlap with the other loop antenna 110*a* and the other open-loop grounding radiator 120*a* after rotating by 180 degrees around the virtual center O. In other words, in the embodiment, the pattern of the dual-feed loop antenna structure 100 is formed by, for example, mirroring the upper half to the lower half and then reversing left and right. In the present embodiment, the shapes of the loop antenna 110 and the open-loop grounding radiator 120 and the shapes of the loop antenna 110*a* and the open-loop grounding radiator 120*a* are designed in a symmetrical manner of mirroring and reversal so that the dual-feed loop antenna structure 100 can resonate at the first frequency band and the second frequency band in a limited space with good signal quality, thereby achieving dual frequency characteristics under the premise of space saving.

In addition, the dual-feed loop antenna structure 100 further includes two coaxial transmission lines 130 individually disposed on the two loop antennas 110 and 110*a*. A positive end of each coaxial transmission lines 130 is connected to the feed-in end (that is, the point A1) of the corresponding loop antennas 110 and 110*a*, and a negative end of each coaxial transmission line 130 is connected to the ground segment (the segment between the points A7 and A8) of the corresponding loop antennas 110 and 110*a*. More specifically, each of the coaxial transmission lines 130 has two ground points located at the points B1 and B2, and the two ground points of each of the coaxial transmission lines 130 are connected to the ground segment (i.e., segment between the points A7 and A8) of the loop antennas 110 and 110*a*. That is, the ground segment (i.e., the segment between the points A7 and A8) of the loop antennas 110 and 110*a* are connected to ground by stripping the two coaxial transmission lines 130 at the points B1 and B2. Certainly, in other embodiments, the coaxial transmission line 130 may also be connected to the ground segment of the loop antennas 110 and 110*a* through one or more ground points.

In this embodiment, since the loop antennas 110 and 110*a* are not directly connected to the system ground plane of the electronic device 10, but are connected to the system ground plane of the electronic device 10 through the coaxial transmission line 130, the disposition and shape of the loop antennas 110 and 110*a* themselves can be more flexible. In addition, the loop antennas 110 and 110*a* may also be connected to a large ground plane through the coaxial transmission line 130, thereby attaining good impedance matching.

In addition, in this embodiment, the length of each coaxial transmission line 130 is between 145 mm and 300 mm, and the distance between the two coaxial transmission lines 130 is between 15 mm and 25 mm, for example, 19 mm. Certainly, the lengths of the coaxial transmission lines 130 and the distance between the two coaxial transmission lines 130 are not limited thereto.

Figure 3:
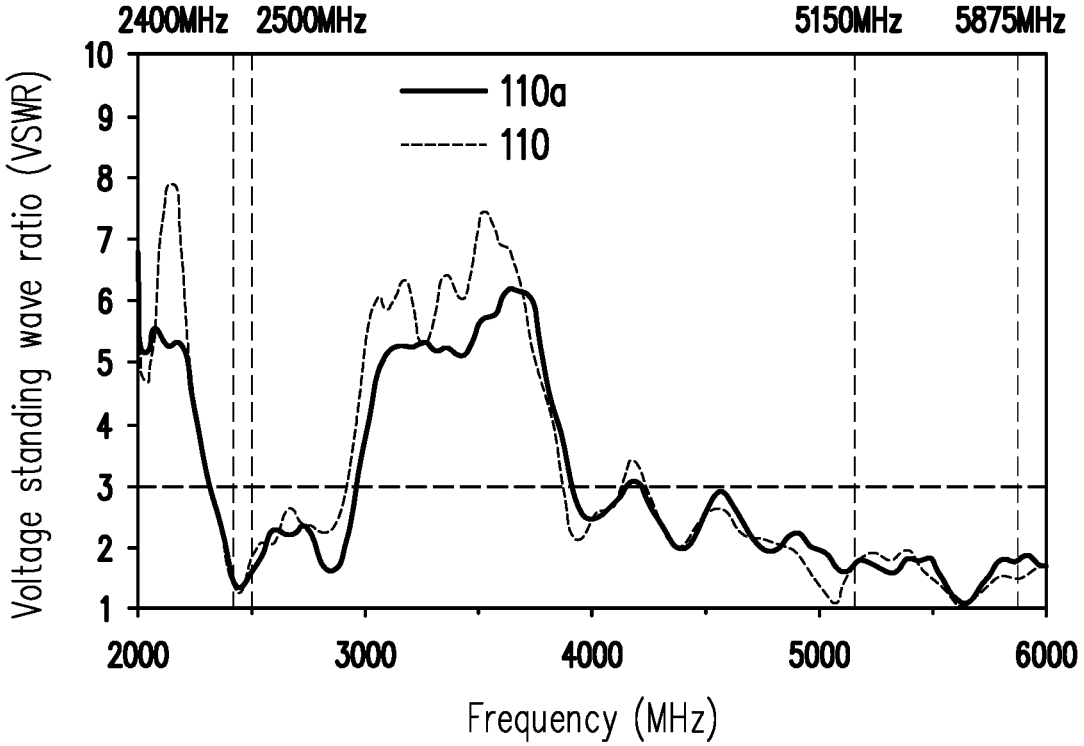
FIG. 3 is a plot of frequency-voltage standing wave ratios of the dual-feed loop antenna structure of FIG. 2.

FIG. 3 is a plot of frequency-voltage standing wave ratios of the dual-feed loop antenna structure of FIG. 2. Referring to FIG. 3, in the embodiment, the voltage standing wave ratios of the two loop antennas 110 and 110*a* at the first frequency band (between 2400 MHz and 2500 MHz, corresponding to WiFi 2.4G) and the second frequency band (between 5150 MHz and 5875 MHz, corresponding to WiFi 5G) are less than 3, so the two loop antennas 110 and 110*a* have good performance.

Figure 4:
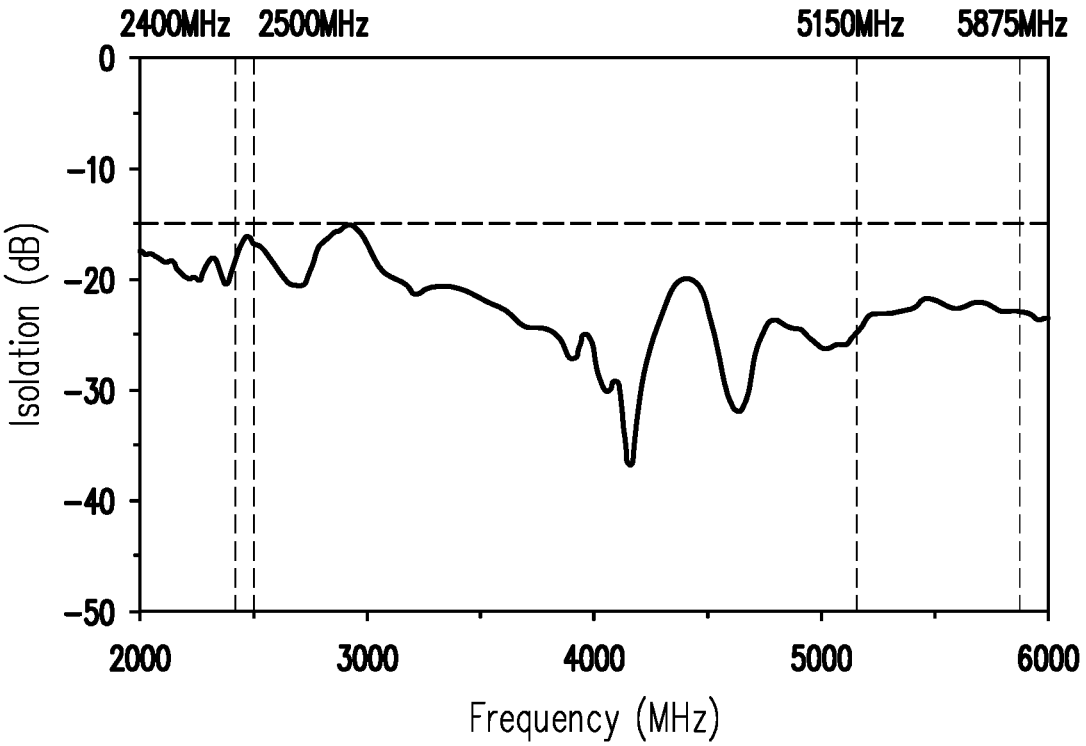
FIG. 4 is a plot showing frequency-isolation of the dual-feed loop antenna structure of FIG. 2.

FIG. 4 is a plot showing frequency-isolation of the dual-feed loop antenna structure of FIG. 2. Referring to FIG. 4, in the embodiment, the isolation of the two loop antennas 110 and 110*a* at the first frequency band (between 2400 MHz and 2500 MHz, corresponding to WiFi 2.4G) and the second frequency band (between 5150 MHz and 5875 MHz, corresponding to WiFi 5G) is less than −15 dB, and even less than −20 dB at the second frequency band, so the two loop antennas 110 and 110*a* do not interfere with each other.

Figure 5:
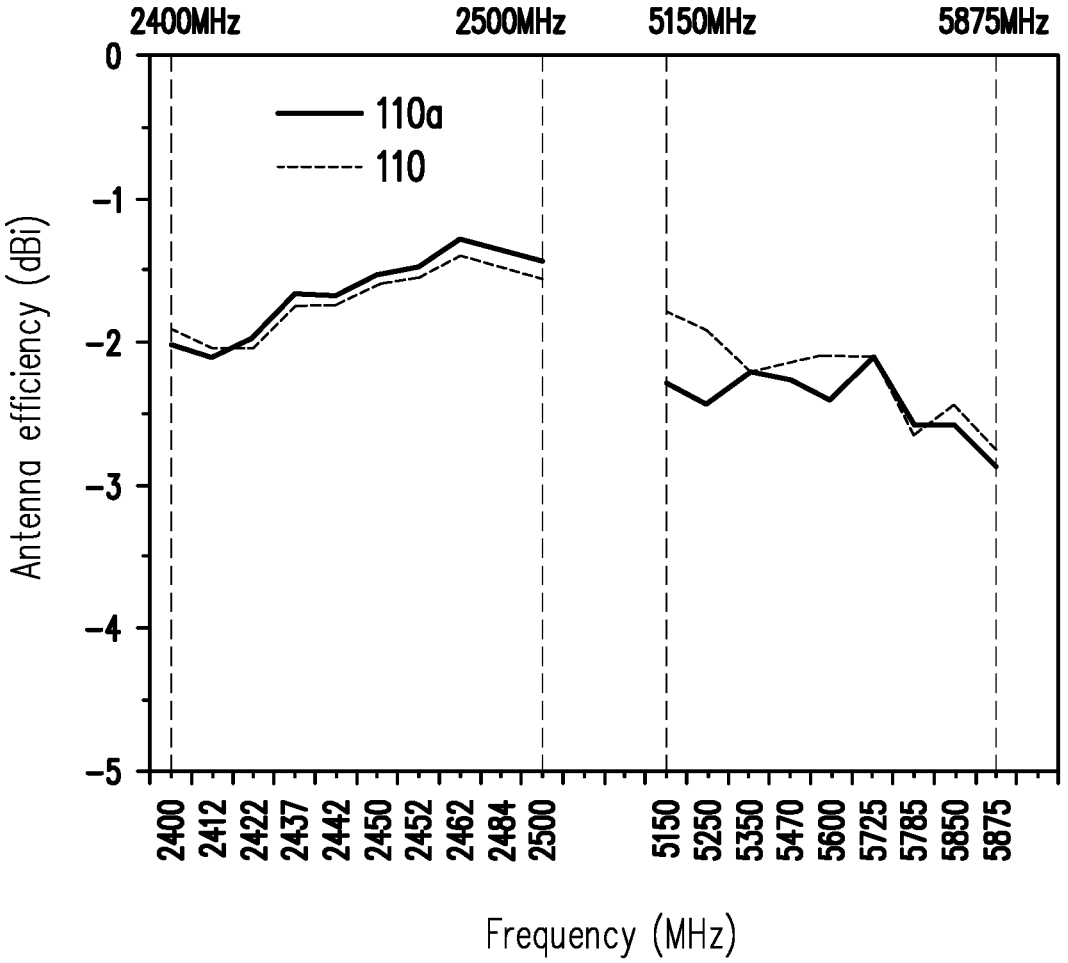
FIG. 5 is a plot of frequency-antenna efficiency of the dual-feed loop antenna structure of FIG. 2.

FIG. 5 is a plot of frequency-antenna efficiency of the dual-feed loop antenna structure of FIG. 2. Referring to FIG. 5, in the embodiment, the antenna efficiency of the two loop antennas 110 and 110*a* at the first frequency band (between 2400 MHz and 2500 MHz, corresponding to WiFi 2.4G) and the second frequency band (between 5150 MHz and 5875 MHz, corresponding to WiFi 5G) is greater than −4 dBi. More specifically, the antenna efficiency of the two loop antennas 110 and 110*a* at the first frequency band (WiFi 2.4G) is −1.2 dBi to −2.0 dBi, and the antenna efficiency of the two loop antennas 110 and 110*a* at the second frequency band (WiFi 5G) is from −1.9 dBi to −2.7 dBi, so the two loop antennas 110 and 110*a* have good antenna efficiency.

Figure 6:
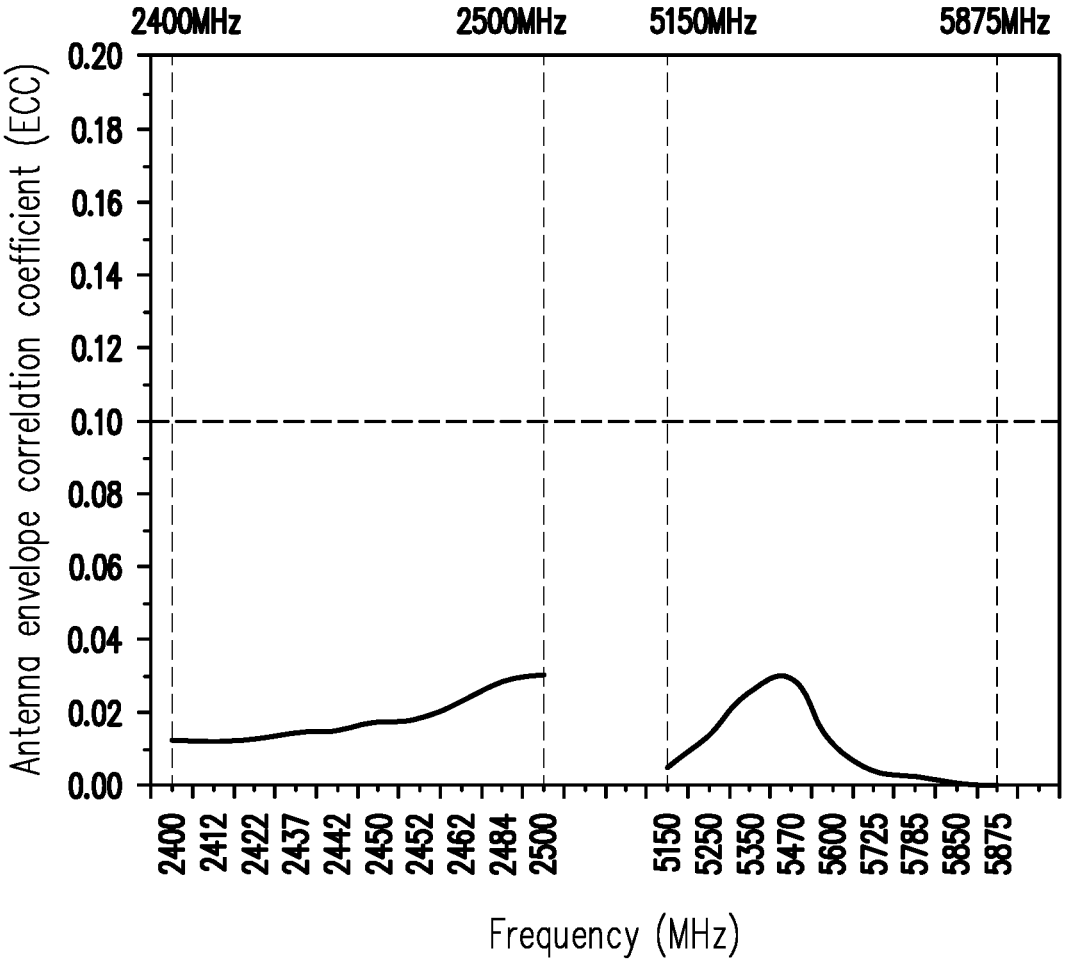
FIG. 6 is a plot of frequency-antenna envelope correlation coefficients of the dual-feed loop antenna structure in FIG. 2.

FIG. 6 is a plot of frequency-antenna envelope correlation coefficients of the dual-feed loop antenna structure in FIG. 2. Referring to FIG. 6, in this embodiment, the envelope correlation coefficients (ECCs) of the two loop antennas 110 and 110*a* at the first frequency band (between 2400 MHz and 2500 MHz, corresponding to WiFi 2.4G) and the second frequency band (between 5150 MHz and 5875 MHz, corresponding to WiFi 5G) is less than 0.1 and even less than 0.03, so the two loop antennas 110 and 110*a* have good performance.

Figure 7A:
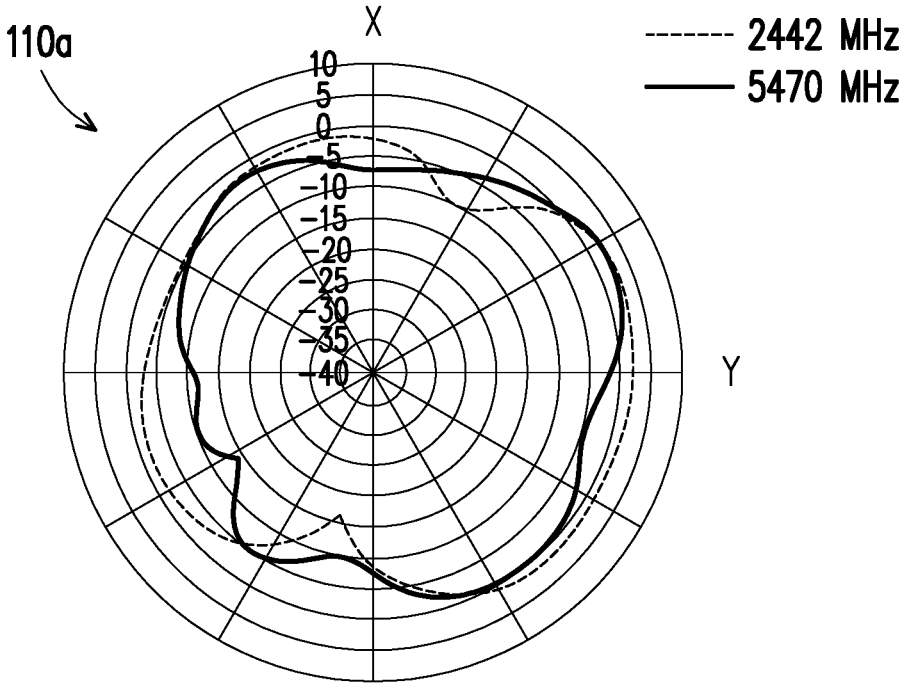
FIG. 7A, FIG. 7B, and FIG. 7C are plots showing radiation patterns of one loop antenna of the dual-feed loop antenna structure in FIG. 2 in an X-Y plane, an X-Z plane, and a Y-Z plane respectively.
Figure 7B:
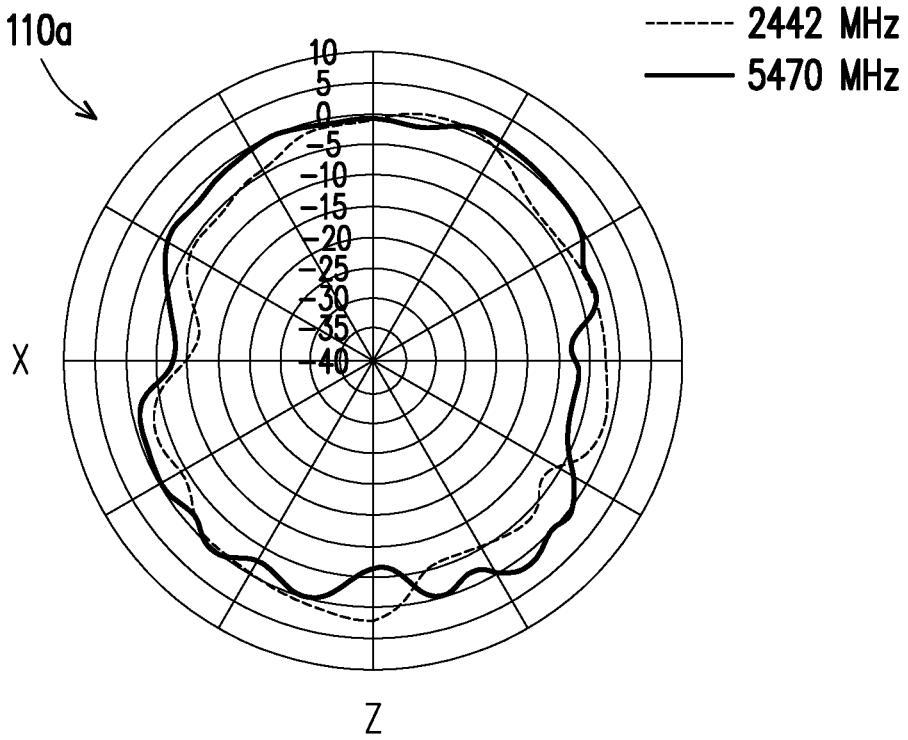
Figure 7C:
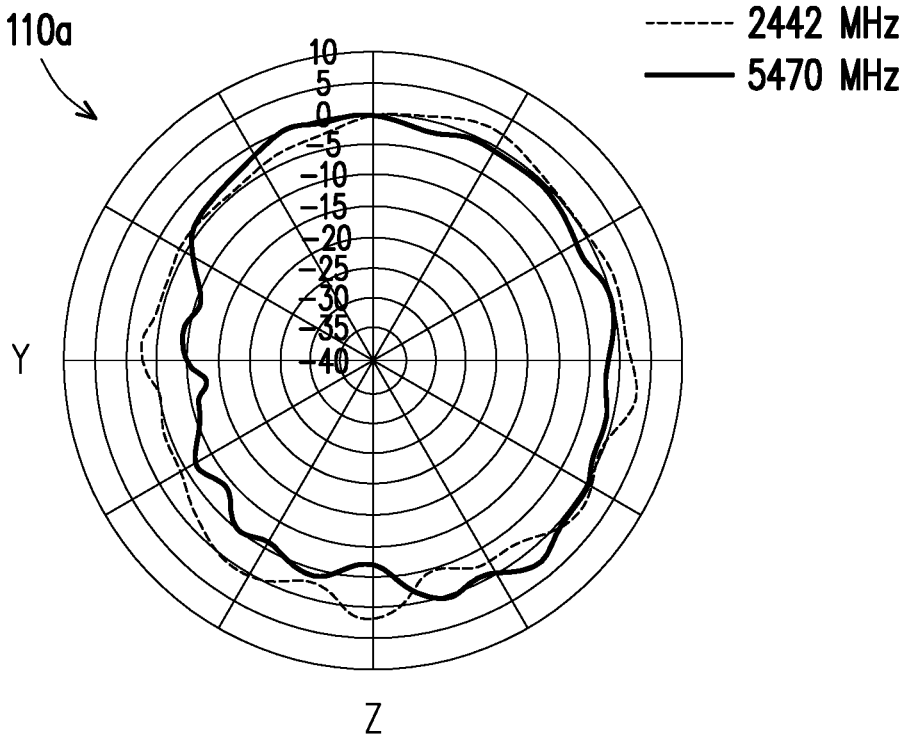
Figure 8A:
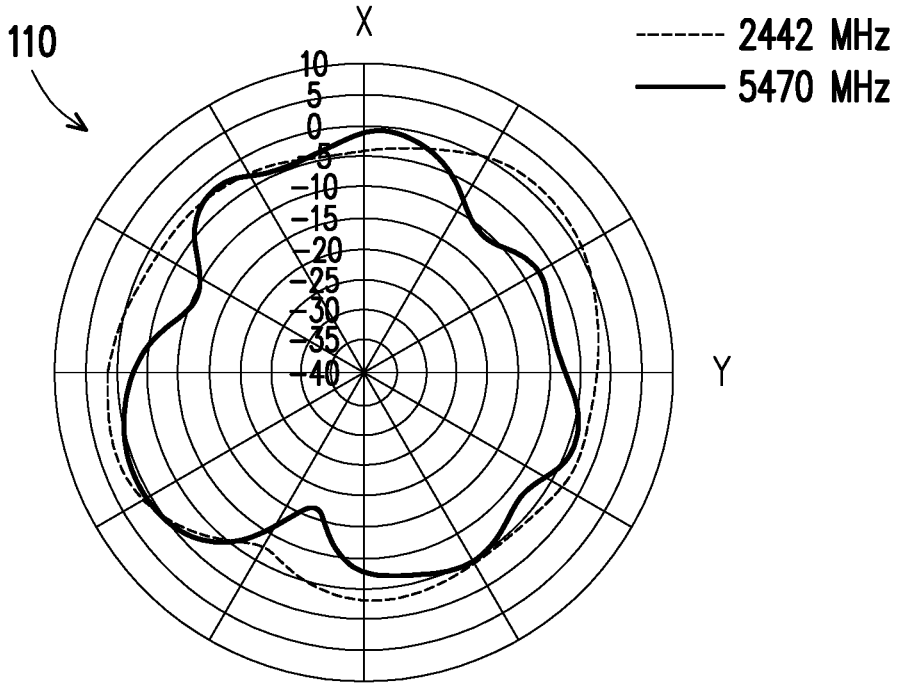
FIG. 8A, FIG. 8B, and FIG. 8C are plots showing radiation patterns of the other loop antenna of the dual-feed loop antenna structure in FIG. 2 in an X-Y plane, an X-Z plane, and a Y-Z plane respectively.
Figure 8B:
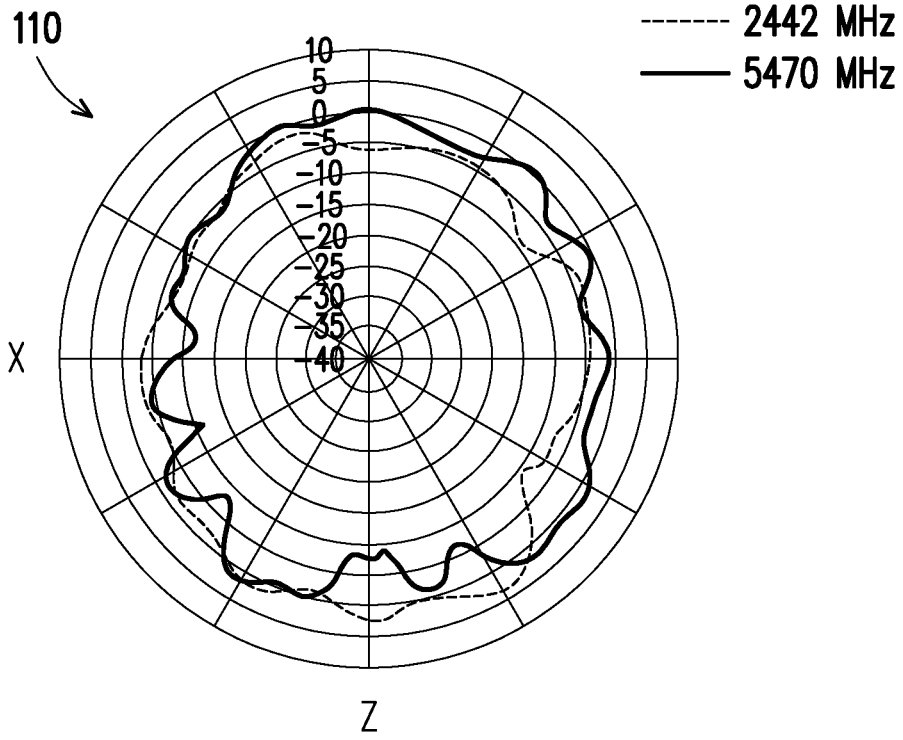
Figure 8C:
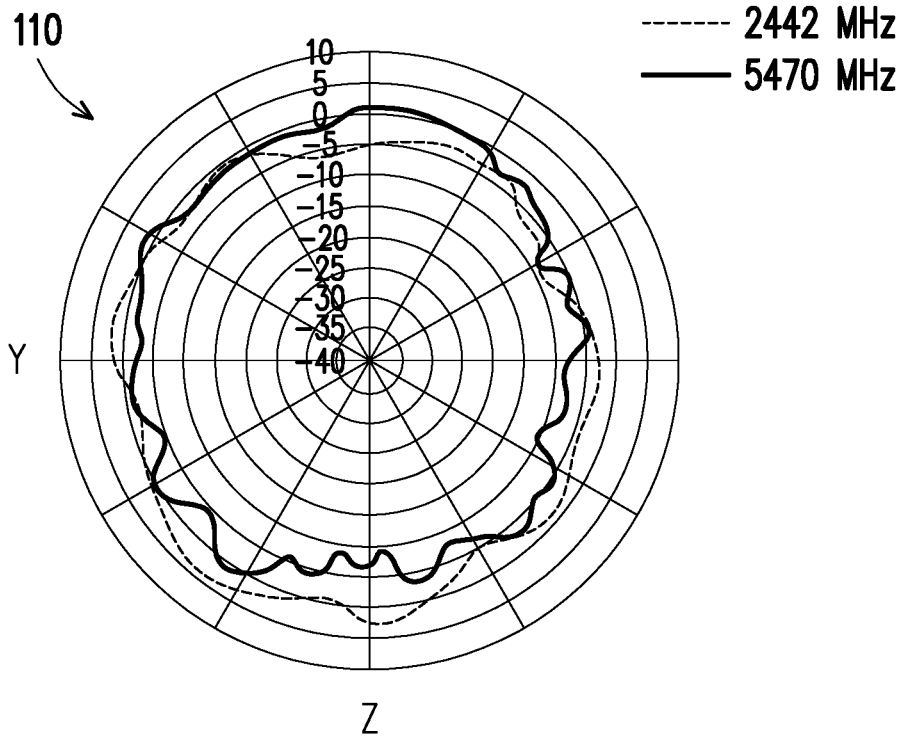

FIG. 7A, FIG. 7B, and FIG. 7C are plots showing radiation patterns of one loop antenna (i.e., loop antenna 110) of the dual-feed loop antenna structure in FIG. 2 in an X-Y plane, an X-Z plane, and a Y-Z plane respectively, wherein the dotted lines represent the first frequency band, and the solid lines represent the second frequency band. FIG. 8A, FIG. 8B, and FIG. 8C are plots showing radiation patterns of the other loop antenna (i.e., loop antenna 110*a*) of the dual-feed loop antenna structure in FIG. 2 in an X-Y plane, an X-Z plane, and a Y-Z plane respectively, wherein the dotted lines represent the first frequency band, and the solid lines represent the second frequency band. Referring to FIG. 7A to FIG. 8C, the radiation pattern of the first frequency band and the radiation pattern of the second frequency band of the two loop antennas 110 and 110*a* do not have null points in the X-Y plane, the X-Z plane and the Y-Z plane. Therefore, the two loop antennas 110 and 110*a* have excellent omnidirectional performance.

Figure 9:
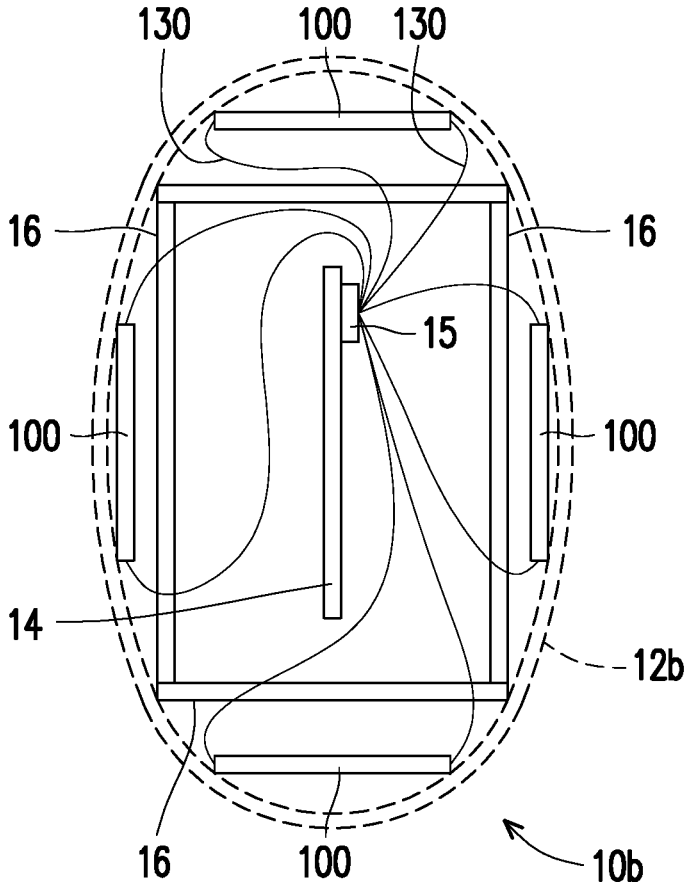
FIG. 9 is a schematic view of an electronic device according to another embodiment of the application.

FIG. 9 is a schematic view of an electronic device according to another embodiment of the application. Referring to FIG. 9, the main difference between the electronic device 10*b* of FIG. 9 and the electronic device 10 of FIG. 1 is that, in FIG. 9, the housing 12*b* of the electronic device 10*b* has the shape of an ellipsoid, and the electronic device 10*b* has a plurality of (for example, four) dual-feed loop antenna structures 100, and each of the dual-feed loop antenna structures 100 has two loop antennas 110 and 110*a* and two open-loop grounding radiators 120 and 120*a*. As shown in FIG. 10, the four dual-feed loop antenna structures 100 are disposed at symmetric positions of the housing 12*b*, for example, upper, lower, left, and right positions. Each of the dual-feed loop antenna structures 100 and the circuit board 14 are separated by the shielding member 16 and connected to the wireless module card 15 of the circuit board 14 through the coaxial transmission line. In this embodiment, the electronic device 10*b* may include a plurality of dual-feed loop antenna structures 100, and each dual-feed loop antenna structure 100 can resonate at the first frequency band and the second frequency band in limited space with good signal quality, thereby achieving dual frequency characteristics.

In summary, the dual-feed loop antenna structure of the present disclosure is designed by disposing two open-loop grounding radiators between two loop antennas and both extending from the two ground segments of the two loop antennas, and there is a coupling gap between the two open-loop grounding radiators. In the above design, for one of the loop antennas (for example, the first loop antenna), the two open-loop grounding radiators of that loop antenna and the other loop antenna (for example, the second loop antenna) can work together as the grounding radiator of the loop antenna (the first loop antenna), such that the loop antenna has a larger ground path, and vice versa. In other words, for each of the two loop antennas, the two open-loop grounding radiators and the other loop antenna can work together as their own grounding radiators, such that each of the loop antennas has a large ground path, providing good impedance matching. In addition, the two open-loop grounding radiators can also provide good isolation for the two loop antennas. Since the two loop antennas can be disposed quite close to each other without mutual interference, the dual-feed loop antenna structure has a rather smaller size. Therefore, the dual-feed loop antenna structure can resonates at the first frequency band and the second frequency band in limited space and thus achieving good dual frequency characteristics.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. An dual-feed loop antenna structure adapted to be disposed on a substrate, the dual-feed loop antenna structure comprising:

two loop antennas, each of the loop antennas adapted to resonate at a first frequency band and a second frequency band, each of the loop antennas comprising a feed-in end and a ground segment; and two open-loop grounding radiators, located between the two loop antennas, each of the open-loop grounding radiators extending from the ground segment of the corresponding loop antenna, and a coupling gap formed between the two open-loop grounding radiators, wherein one of the loop antennas and the open-loop grounding radiator connected thereto completely overlap the other loop antenna and the other open-loop grounding radiator connected thereto after being mirrored and reversed.

2. The dual-feed loop antenna structure according to claim 1, wherein the coupling gap has a width of between 0.5 mm and 1.5 mm.

3. The dual-feed loop antenna structure according to claim 1, wherein a length of each of the loop antennas is in a range between ¾ wavelength and 1 wavelength of the first frequency band.

4. The dual-feed loop antenna structure according to claim 1, wherein a sum of lengths of the two open-loop grounding radiators is ½ wavelength of the first frequency band.

5. The dual-feed loop antenna structure according to claim 1, wherein a length of each of the open-loop grounding radiators is ¼ wavelength of the first frequency band.

6. The dual-feed loop antenna structure according to claim 1, wherein a length of the ground segment of each loop antenna is ¼ wavelength of the first frequency band.

7. The dual-feed loop antenna structure according to claim 1, further comprising:

two coaxial transmission lines, disposed on the two respective loop antennas, wherein a positive end of each coaxial transmission line is connected to the feed-in end of the corresponding loop antenna, and a negative end of each coaxial transmission line is connected to the ground segment of the corresponding loop antenna.

8. The dual-feed loop antenna structure according to claim 7, wherein each of the coaxial transmission lines has a length of between 145 mm and 300 mm.

9. The dual-feed loop antenna structure according to claim 1, wherein each of the loop antennas comprises a first extension segment extending from the feed-in end, and a length or a width of the first extension segment is adjusted to adjust impedance matching of the second frequency band.

10. The dual-feed loop antenna structure according to claim 1, wherein each of the loop antennas comprises a second extension segment extending from a corner near the feed-in end, and a length or a width of the second extension segment is adjusted to adjust impedance matching of the first frequency band.

11. The dual-feed loop antenna structure according to claim 1, wherein the first frequency band is between 2400 MHz and 2500 MHz, and the second frequency band is between 5150 MHz and 5875 MHz.

12. An electronic device, comprising:

a housing;

a circuit board, disposed in the housing;

at least one dual-feed loop antenna structure claimed in claim 1, disposed in the housing with signal connection to the circuit board; and at least one shielding member, disposed in the housing and located between the at least one dual-feed loop antenna structure and the circuit board.

13. The dual-feed loop antenna structure according to claim 12, wherein a distance between the at least one dual-feed loop antenna structure and the corresponding shielding member is between 15 mm and 70 mm.

14. The dual-feed loop antenna structure according to claim 12, wherein the housing is a cylinder, an ellipsoid, a cuboid, a trapezoidal column, or a rugby ball body.

15. The dual-feed loop antenna structure according to claim 12, wherein the at least one dual-feed loop antenna structure comprises a plurality of dual-feed loop antenna structures symmetrically disposed in the housing.

* * * * *